US006056582A

United States Patent [19]

Okabe

[11] Patent Number: 6,056,582

[45] Date of Patent: May 2, 2000

[54] LEVER FITTING CONNECTOR

[75] Inventor: Toshiaki Okabe, Shizuoka, Japan

[73] Assignee: Yazaki Corporation, Tokyo, Japan

[21] Appl. No.: 09/103,933

[22] Filed: Jun. 25, 1998

[30] Foreign Application Priority Data

Jul. 1, 1997 [JP] Japan ..... 9-175824

[51] Int. Cl.[7] ..... H01R 13/62

[52] U.S. Cl. ..... 439/372

[58] Field of Search ..... 439/157, 152, 439/372, 155

[56] References Cited

U.S. PATENT DOCUMENTS 5,681,175 10/1997 Busse ..... 439/157

5,711,682 1/1998 Maejima ..... 439/157

*Primary Examiner*—Neil Abrams

*Assistant Examiner*—Javaid Nasri

*Attorney, Agent, or Firm*—Sughrue, Mion, Zinn, Macpeak & Seas, PLLC

[57] ABSTRACT

A lever fitting connector is disclosed. The connector comprises a female connector having a hood-like outer peripheral wall, a male connector fitted into the female connector, a lever body supported rotatably on an outer face of a side wall of the male connector, a engaging projection, provided at one end of the lever body, for engaging with the outer peripheral wall of the female connector, and an operation portion, provided at the other end of the lever body, for fitting the male connector with the female connector by rotating the lever body about a portion where the engaging projection is engaged with the outer peripheral wall of the female connector, wherein at least the lever body is located inside of the outer peripheral wall of the female connector when the male connector is completely fitted into the female connector.

11 Claims, 10 Drawing Sheets

LEVER FITTING CONNECTOR

BACKGROUND OF THE INVENTION

1. Field of the Invention

The present invention relates to a connector in which fitting of male and female connectors is performed by operating a lever.

2. Background of the Related Art

FIG. 10 shows a conventional frame, connecting connector 1 which is disclosed in Unexamined Japanese Patent Publication No. Hei 6-251826. The connector 1 comprises: a female connector section 3 which is disposed on a box main body 2 such as an electrical junction box; a male connector 5 which is to be inserted and fitted into a hood portion 4 of the female connector section 3; and a frame 6 which causes the male connector 5 to be inserted and fitted into the female connector section 3. The frame 6 consists of a main body 7 in which the male connector 5 is rotatably housed, a rotation leg 8 which protrudes from one end of the main body 7, and an operating projection 9 which projects from the other end. A sliding shaft 10 is formed at the tip end portion of the rotation leg 8. The sliding shaft 10 is inserted into and engagingly held to a slide groove 12 of a frame support 11 which is disposed in the periphery of the female connector section 3.

As shown in FIG. 11, the sliding shaft 10 is engagingly held in the slide groove 12, and the operating projection 9 is pressed so that the frame 6 is rotated in the direction of the arrow A about the sliding shaft 10, whereby the male connector 5 is inserted and fitted into the female connector section 3. In the state that the male connector 5 is fitted into the female connector section 3, the operating projection 9 is pressed in the reverse direction so that the frame 6 is rotated in the direction opposite to that of the arrow A, whereby the male connector 5 is removed from the hood portion 4 of the female connector section 3.

In this case, the sliding shaft 10 functions as the fulcrum, so that the operating projection 9 becomes a point where force is applied, and that portion of the male connector 5 rotatably supported by the frame 6 becomes a point of action, thereby enabling the male connector 5 to be fitted into the female connector section 3 with a small force. Therefore, the operating force to be exerted when the male connector 5 is fitted into the female connector section 3 can be reduced.

In the frame connecting connector 1, however, the rotation leg 8 on which the sliding shaft 10 functions as the fulcrum and the operating projection 9 are provided so as to be protruded from the main body 7. Therefore, the frame 6 occupies a large space. This impedes the overall miniaturization of a frame-coupling type connector.

The connector has a further drawback that the main body 7 which is disposed on the outside of the male connector 5 is bent during an operation and hence the portion where the male connector 5 is rotatably supported is easily detached.

SUMMARY OF THE INVENTION

It is an object of the present invention to provide a lever fitting connector in which a lever is prevented from being detached, and which can be miniaturized and occupy a small space.

In order to attain the object, there is provided a lever fitting connector comprising a female connector having a hood-like outer peripheral wall, an a male connector fitted into the female connector, a lever body supported rotatably on an outer face of a side wall of the male connector, a engaging projection, provided at one end of the lever body, for engaging with the outer peripheral wall of the female connector, and an operation portion, provided at the other end of the lever body, for fitting the male connector with the female connector by rotating the lever body about a portion where the engaging projection is engaged with the outer peripheral wall of the female connector, wherein at least the lever body is located inside of the outer peripheral wall of the female connector when the male connector is completely fitted into the female connector.

In the lever fitting connector, the male connector is positioned to the outer peripheral wall of the female connector, and the engaging projection provided at the one end of the lever body is engagingly held to the outer peripheral wall of the female connector. Under this state, the lever body is rotated about a portion where the engaging projection is engagingly held to the outer peripheral wall of the female connector, by operating the operating portion, and the male connector is inserted into the outer peripheral wall of the female connector, thereby coupling the terminals with each other. As a result, the male connector is fitted into the female connector. At this time, at least the lever body is located inside the outer peripheral wall of the female connector.

In the lever fitting connector, under the state where the connector body is fitted into the outer peripheral wall of the female connector, at least the lever body is located inside the outer peripheral wall of the female connector. Therefore, the lever body does not project to the outsides of the male connector and female connector. Consequently, the connector can be miniaturized as a whole, and the space occupied by the whole of the lever fitting connector can be reduced. Furthermore, inside the outer peripheral wall of the female connector, since at least the lever body is interposed between the outer peripheral wall of the female connector and the side wall of the male connector, even when the lever body is bent toward the outside of the male connector, the lever body is blocked by the outer peripheral wall of the female connector, so that the lever body is prevented from being disengaged from the male connector.

The lever fitting connector further comprises a provisional fixing member for provisionally fixing the lever body at a predetermined position before the male connector is fitted into the female connector.

In this manner, the lever body is provisionally fixed at the provisional fixing position of the male connector. During operations of positioning and inserting the male connector to the female connector, therefore, the lever body does not impede the operations.

In the lever fitting connector, the provisional fixing member includes a provisional fixing protrusion which is protruded from the outer face of the side wall of the male connector, and a provisional fixing hole which is formed in the lever body, the provisional fixing protrusion being inserted into and engagingly held to the provisional fixing hole.

In this manner, when the lever body is rotated to the provisional fixing position with respect to the male connector, the provisional fixing protrusion of the male connector is inserted into and engagingly held to the provisional fixing hole of the lever body and the lever body is held at the provisional fixing position of the male connector.

In the lever fitting connector, a notch is formed in the female connector so as to communicate an interior and an exterior of the outer peripheral wall of the female connector communicating with each other, and the engaging projection is inserted into and engagingly held to the notch.

In this manner, when the male connector is positioned on the outer peripheral wall of the female connector, the male connector is inserted into the outer peripheral wall of the female connector, and the lever is rotated, the engaging projection disposed at the one end of the lever body is engagingly held to the notch of the outer peripheral wall of the female connector. When the lever is further rotated, the lever body is rotated about the portion where the projection is engagingly held to the notch, and the male connector is inserted and fitted into the female connector.

Moreover, since the interior and exterior of the outer peripheral wall of the female connector communicate with each other through the notch to which the projection is engagingly held, it is possible to easily check whether the projection is surely engagingly held to the notch or not.

In the lever fitting connector, the lever body includes a pair of lever walls which are rotatably supported on outer faces of side walls of the male connector, respectively, the engaging projection is provided at one end of each of the lever walls, and the operating portion is formed so as to couple the other ends of the pair of lever walls with each other.

In this manner, the lever walls are disposed on the side walls of the male connector, respectively. When the male connector is to be inserted into the outer peripheral wall of the female connector, therefore, an unbalanced force is not applied to the male connector and the male connector can be inserted and fitted into the female connector while the male connector is moved toward the outer peripheral wall of the female connector along the correct direction of fitting into the female connector.

In the lever fitting connector, the pair of lever walls are rotatably supported on supporting projections which respectively project from the outer faces of the side walls of the male connector, and wherein, the lever walls are located inside of the outer peripheral wall of the female connector when the male connector is completely fitted into the female connector.

In this manner, since the lever walls are interposed between the side walls of the male connector and the inner walls of the hood portion, respectively, the bending of the lever walls is restricted by the outer peripheral wall of the female connector, so that the lever walls are prevented from being disengaged from the supporting projection of the male connector.

In the lever fitting connector, grooves may be provided in the male connector, the grooves guiding and supporting the projections when the lever walls are rotated about portions where the engaging projections are engagingly held to the female connector.

In this manner, when the lever walls are rotated about the portions where the engaging projections are engagingly held to the outer peripheral wall of the female connector, the engaging projections are guided and supported by the grooves disposed in the male connector. Even when the lever walls are bent, therefore, the lever walls are prevented from being disengaged from the portions where the engaging projections are engagingly held to the hood portion.

In the lever fitting connector, thickened portions may be provided respectively on inner faces of the outer peripheral wall of the female connector, the thickened portions abut against and support the lower portion of the one end of the lever body in which the engaging projections are provided.

In this manner, when the male connector is inserted into the female connector after the male connector is positioned on outer peripheral wall of the female connector, the end faces of the lever walls on the side of the projections abut against the upper faces of the thickened portions, thereby positioning the projections with respect to the notches. When the lever body is slightly rotated under this state, the projections are engagingly held to the notches. When the lever body is further rotated, the male connector is inserted and fitted into the female connector.

In the lever fitting connector, thickened portions may be provided respectively on the side walls of the male connector for restricting movement thereof when the male connector is completely fitted into inside of the outer peripheral wall of the female connector.

Moreover, the thickened portions in the male connector may further include position restriction projections which are respectively protruded therefrom, the outer peripheral wall of the female connector further includes position restriction grooves provided on the inner faces thereof, and the position restriction projections is respectively engaged with the position restriction grooves when the male connector is completely fitted into the female connector.

In this manner, since the position restriction members are provided on the side walls of the male connector and the lower portions of the lever walls, it is possible to eliminate gaps which may be formed by respectively interposing the lever walls between the male connector and the inner walls of the hood portion, and which correspond to the thickness of the lever walls. As a result, the rattling of the male connector in the female connector is suppressed, and a force which is applied to portions where the terminals projecting into the female connector are contacted with the terminals in the male connector is reduced.

BRIEF DESCRIPTION OF THE DRAWINGS

In the accompanying drawings:

FIG. 4(*b*) is a section view showing the interior of the lever fitting connector of the first embodiment;

FIG. 4(*c*) is a side view of the lever fitting connector of the first embodiment;

FIG. 5(*b*) is a section view showing a state where the connector body is completely inserted into the hood portion in the lever fitting connector of the first embodiment;

FIG. 8(*b*) is a section view showing the interior of the lever fitting connector of the second embodiment;

FIG. 8(*c*) is a side view of the lever fitting connector of the second embodiment;

FIG. 9(*b*) is a section view showing a state where the connector body is inserted into a hood portion to the provisional fixing position in the lever fitting connector of the second embodiment;

FIG. 9(*c*) is a section view showing a state where the connector body is completely inserted into the hood portion in the lever fitting connector of the second embodiment;

DETAILED DESCRIPTION OF THE PREFERRED EMBODIMENTS

Figure 1:
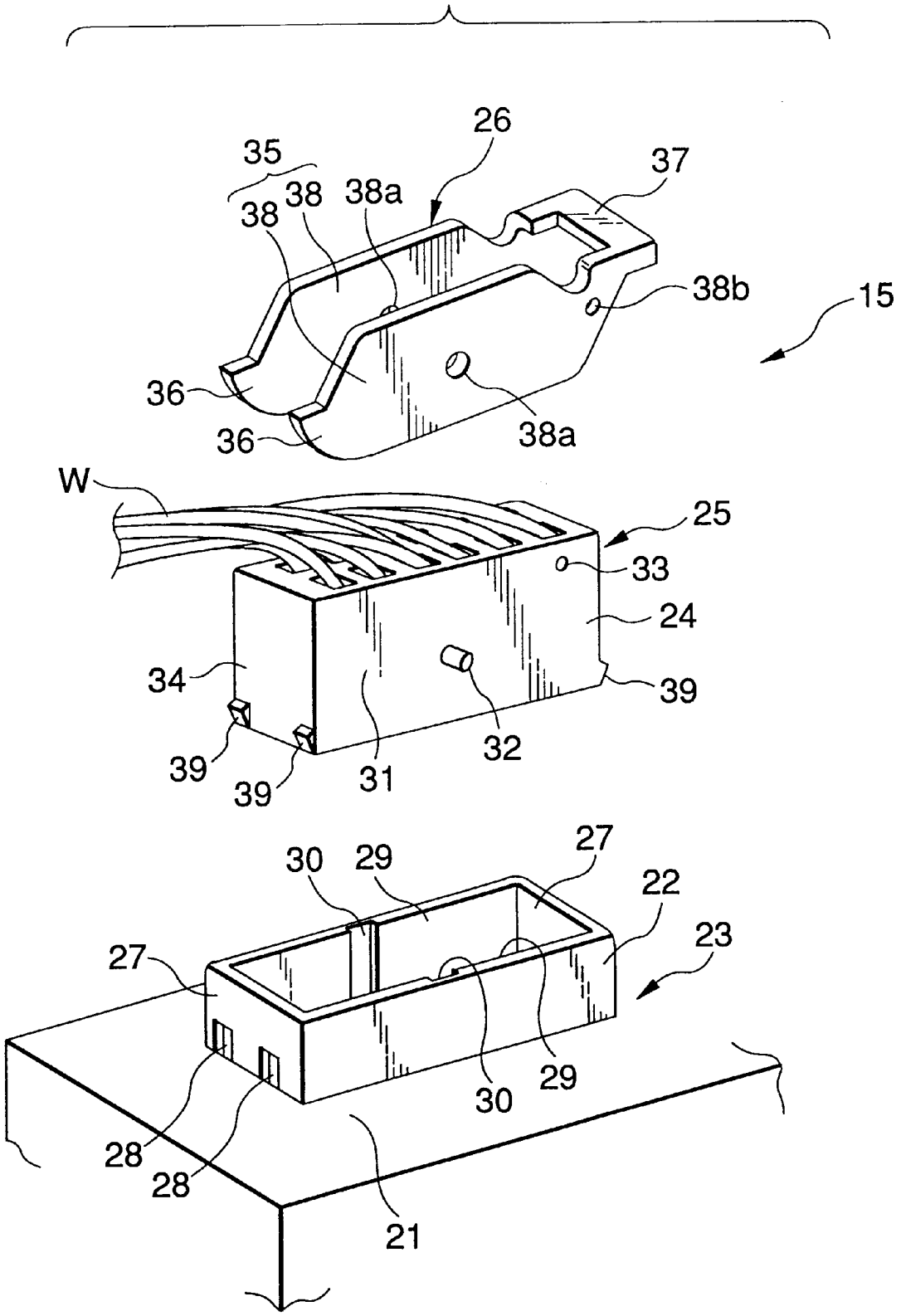
FIG. 1 is an exploded perspective view showing a first embodiment of the lever fitting connector of the present invention.
Figure 2:
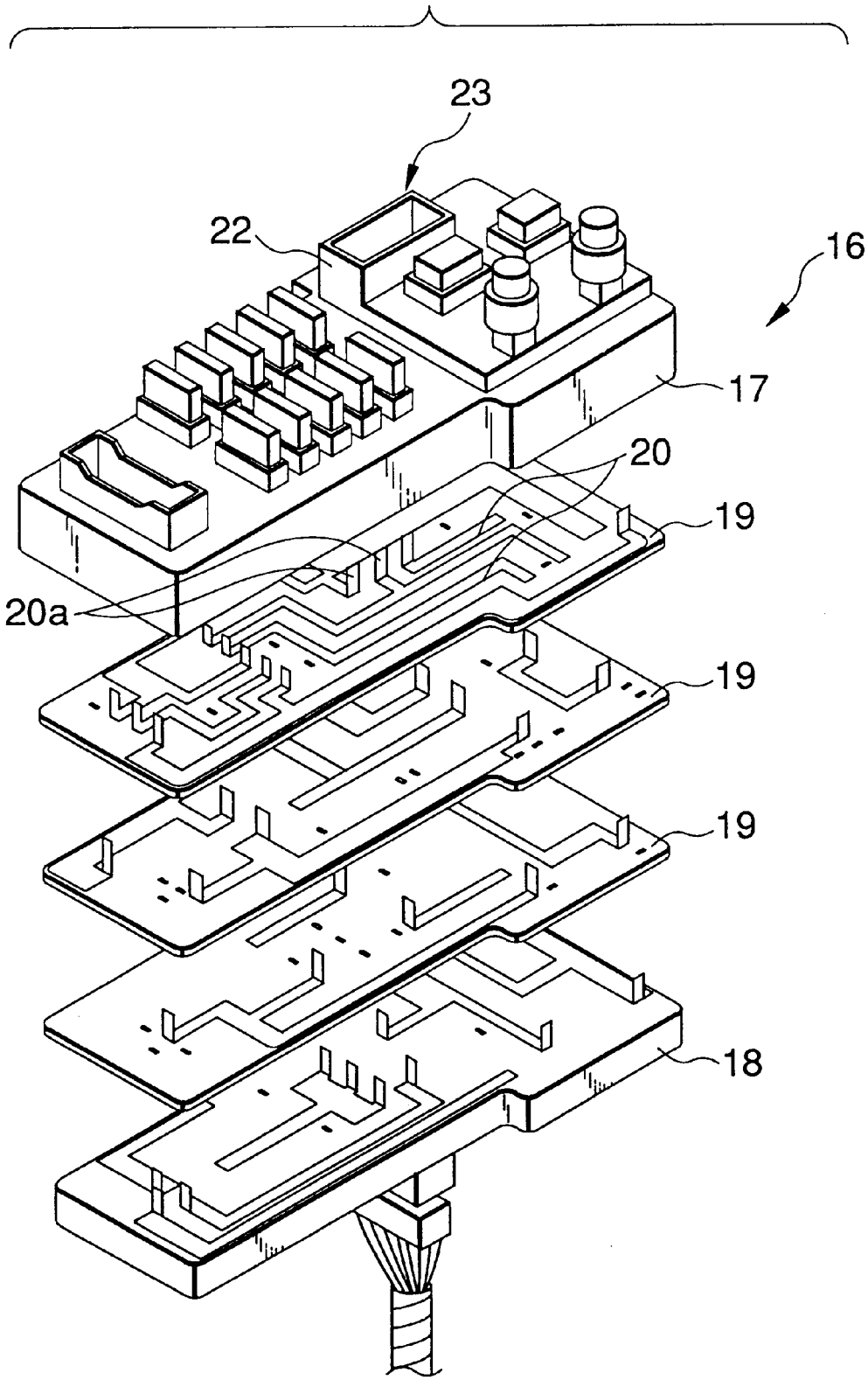
FIG. 2 is an exploded perspective view showing an electric junction box to which the lever fitting connector of the first embodiment is applied.

There will be described below in detail preferred embodiments of the present invention.

1. First Embodiment

A lever fitting connector (hereinafter, referred to as "connector") 15 of a first embodiment shown in FIGS. 1 to 5 will be described. The connector 15 is used in an upper cover 17 of an electric junction box 16 shown in FIG. 2, and for connecting bus bars 20 on circuit boards 19 stacked between the upper cover 17 and a lower cover 18, with terminal portions of a wire harness.

Figure 3:
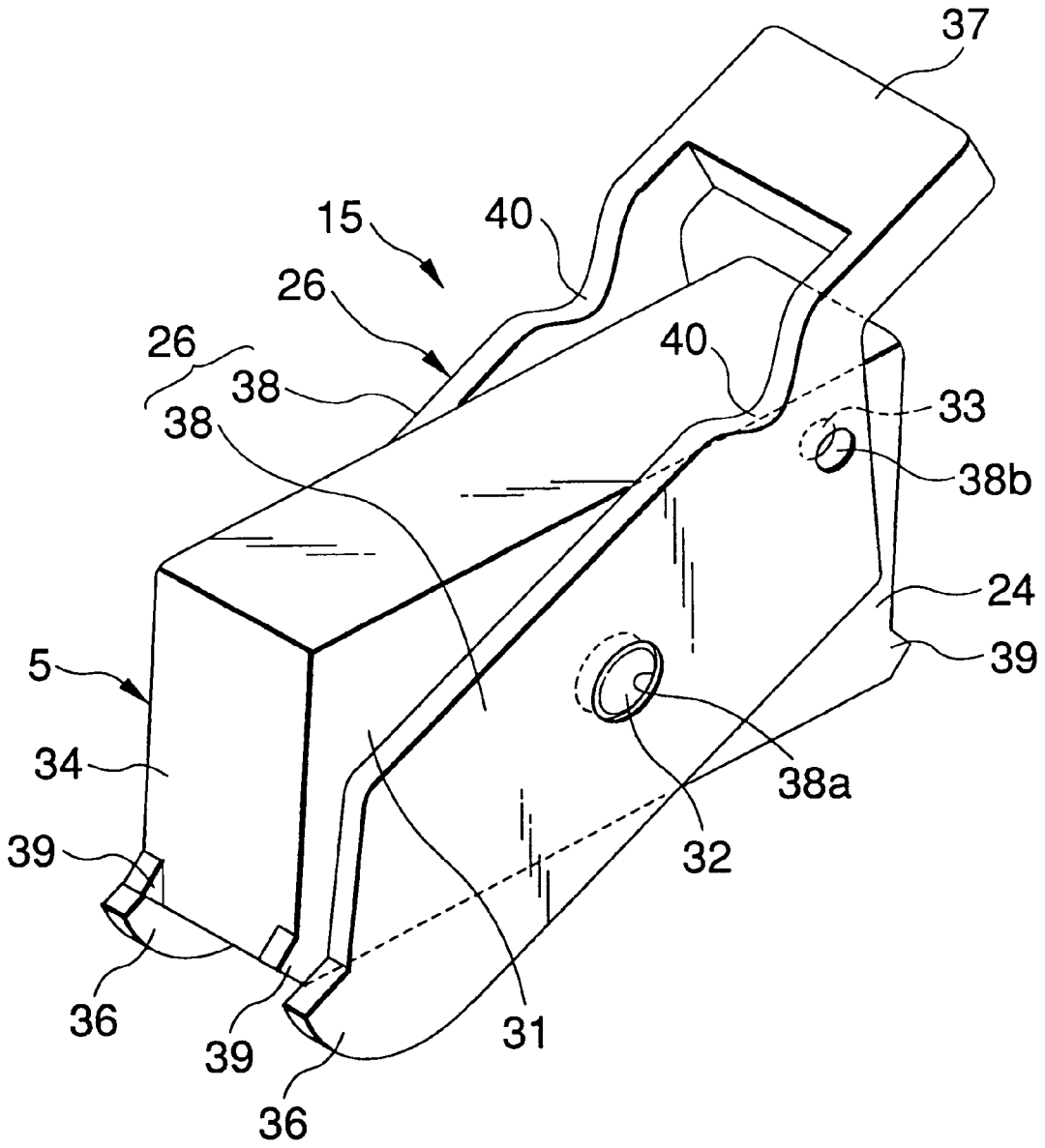
FIG. 3 is a perspective view showing a male connector of the lever fitting connector of the first embodiment, and a lever which is disposed on the outside of the male connector.

As shown in FIGS. 1 and 3, the connector 15 comprises: a female connector section 23 in which a hood portion 22 is formed integrally with a housing portion 21 of the upper cover 17; a male connector 25 having a connector body 24 which is to be inserted and fitted into the hood portion 22 of the female connector section 23; and a lever 26 which is disposed on the outside of the connector body 24 of the male connector 25 and which causes the connector body 24 to be inserted and fitted into the hood portion 22 of the female connector section 23.

In the female connector section 23, terminal portions of the bus bars 20 are housed in the housing portion 21, and male terminals 20*a* (see FIG. 2) of the terminal portions project into the hood portion 22. In the hood portion 22, two notches 28 through which the interior and exterior of the hood portion 22 communicate with each other are formed in each of opposing walls 27. Grooves 30 which elongate in the fitting direction of the connector body 24 are formed at middle portions of inner walls 29 of the hood portion 22, respectively. The connector body 24 of the male connector 25 is inserted into the hood portion 22 and female terminals (not shown) housed in the connector body 24 are electrically contacted with the male terminals 20*a*.

The male connector 25 has a plurality of terminal chambers provided in the connector body 24. The female terminals are housed in the terminal chambers, respectively. The mating male terminals 20*a* are to be inserted into the terminal chambers from one side, and electric wires W which are connected at ends to the female terminals are lead out from the other side. A cylindrical boss 32 projects from a center portion of each of the side walls 31 (in FIG. 1, only one of the side walls is shown) of the connector body 24. A provisional fixing protrusion 33 which is smaller than the bosses 32 is protruded from a position which is at the upper and right side in FIG. 1 with respect to the corresponding boss 32. The bosses 32 are respectively inserted into rotation holes 38*a* formed in lever walls 38 which will be described later. Tip end portions of the bosses 32 projecting from the rotation holes 38*a* are inserted into the grooves 30 provided in the hood portion 22. The provisional fixing protrusions 33 are inserted into and engagingly held to provisional fixing holes 38*b* formed in the lever walls 38, respectively.

Furthermore, provisional fixing projections 39 project from side ends of each of side walls 34 of the connector body 24, on the side of fitting faces. When the connector body 24 is inserted into the hood portion 22 (before the fitting by means of the lever 26 is done), the provisional fixing protrusions 39 are inserted into and engagingly held to the notches 28 of the hood portion 22, so as to provisionally hold the connector body 24 to the hood portion 22. The lever 26 is disposed on the outside of the connector body 24.

The lever 26 consists of: a lever body 35 which is rotatably supported on the connector body 24 of the male connector 25; projections 36 which are formed at one end of the lever body 35, and which, when the connector body 24 is fitted into the hood portion 22, are engagingly held to the hood portion 22; and an operating portion 37 which is provided at the other end and which causes the lever body 35 to be rotated about the portions where the projections 36 are engagingly held to the hood portion 22, thereby fitting the connector body 24 into the hood portion 22. In the lever 26 of the embodiment, as shown FIGS. 4(*a*), 4(*b*), and 4(*c*), the lever body 35 is positioned inside the hood portion 22 under a state where the connector body 24 is fitted into the hood portion 22.

The lever body 35 consists of a pair of thin plate-like lever walls 38 which are rotatably supported on wall faces of the side walls 31 of the connector body 24, respectively. Each of the projections 36 is provided at one end of the corresponding lever wall 38. The operating portion 37 is formed by coupling the other ends of the pair of lever walls 38 with each other. The rotation holes 38*a* are formed at substantially center portions of the lever walls 38, respectively. The bosses 32 are inserted into the rotation holes 38*a*, thereby allowing the lever walls 38 to be rotated on the wall faces of the side walls 31 of the connector body 24.

Figure 4A:
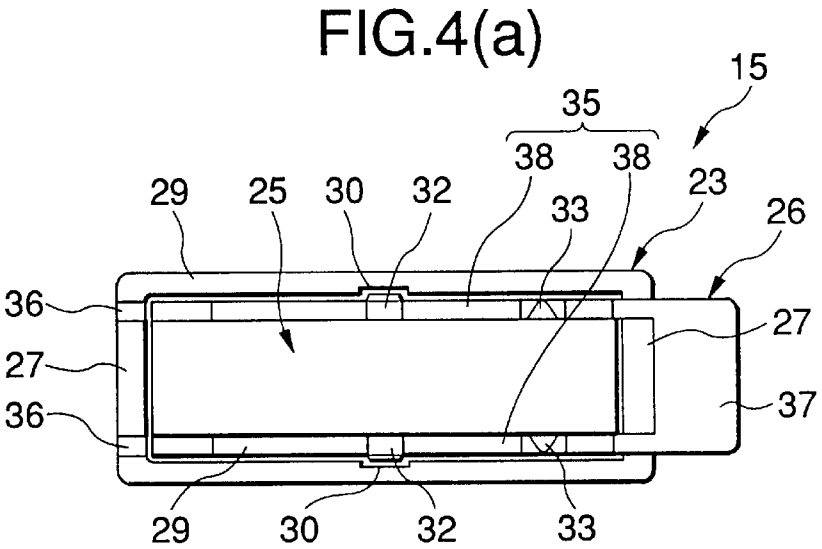
FIG. 4(*a*) is a plan view showing a state where the male connector is fitted into a female connector section in the lever fitting connector of the first embodiment.
Figure 4B:
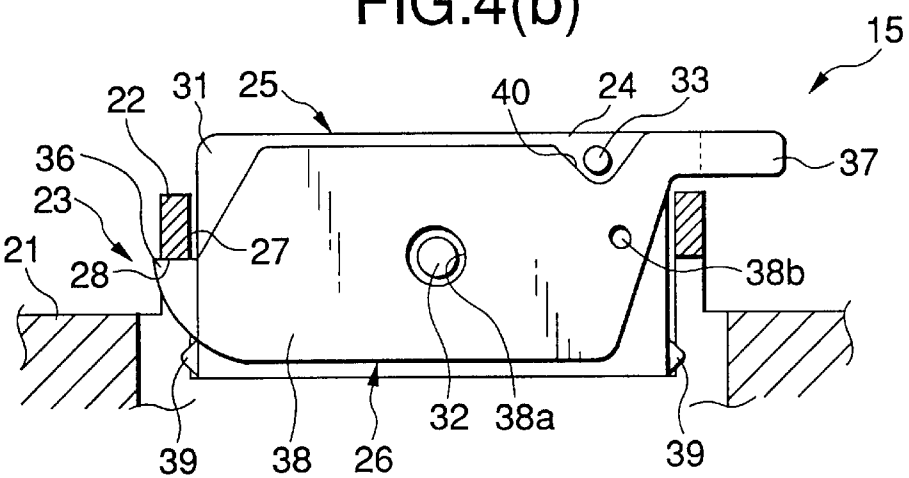
Figure 4C:
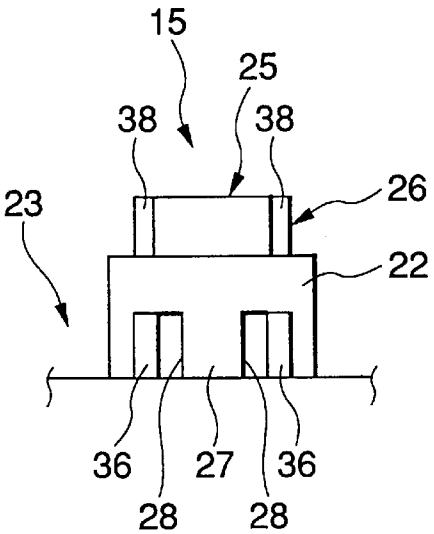

The provisional fixing holes 38*b* are formed in the lever walls 38, on the side of the operating portion 37. The provisional fixing protrusions 33 protruded from the side walls 31 of the connector body 24 are inserted into and engagingly held to the provisional fixing holes 38*b*, so that the lever body 35 is held at a provisional fixing position with respect to the connector body 24. The provisional fixing protrusions 33 and the provisional fixing holes 38*b* constitute the provisional fixing members. Regular engaging recesses 40 are respectively formed in the lever walls 38, on the side of the operating portion 37. Under a state where the connector body 24 is completely fitted into the hood portion 22, as shown in FIG. 4, the lever walls 38 are interposed between the inner walls 29 of the hood portion 22 and the side walls 31 of the connector body 24.

Next, the procedure of fitting the male connector 25 into the female connector section 23 in the connector of the embodiment will be described.

Figure 5A:
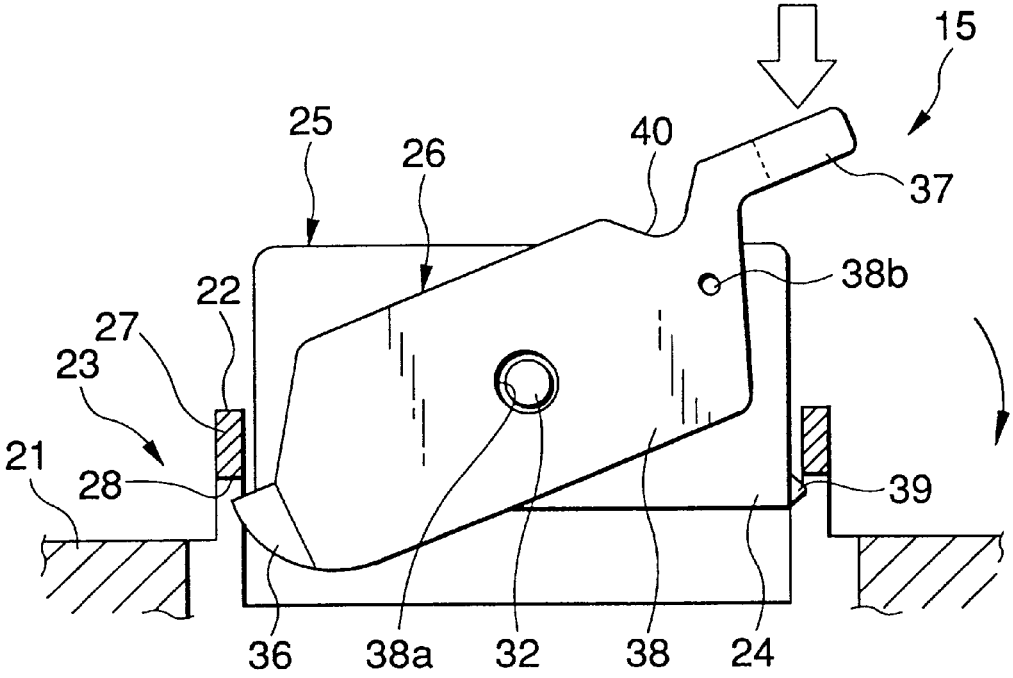
FIG. 5(*a*) is a section view showing a state where a connector body is inserted into a hood portion to a provisional fixing position in the lever fitting connector of the first embodiment.
Figure 5B:
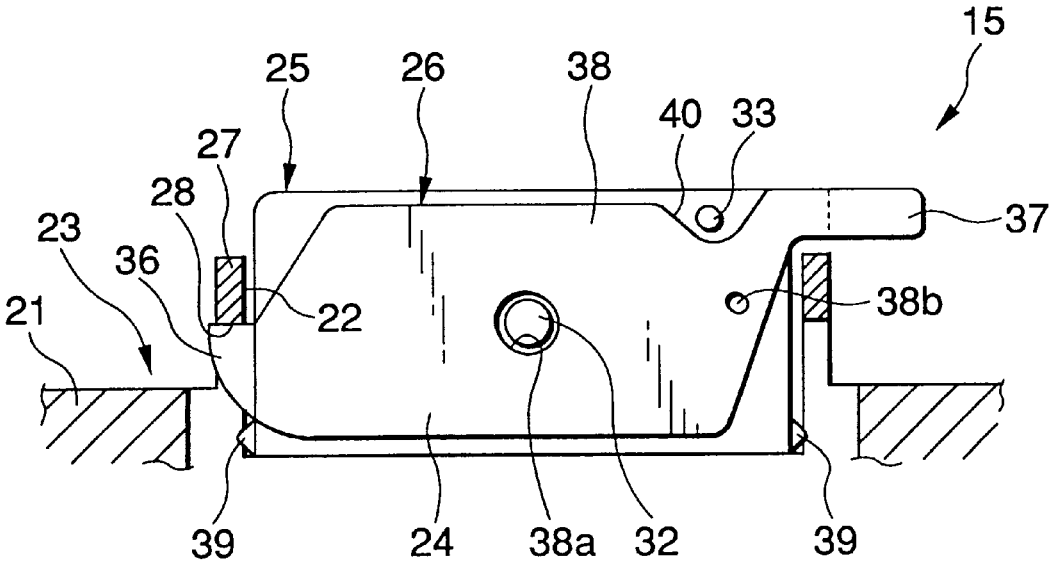

Under a state where the provisional fixing protrusions 33 are inserted into and engagingly held to the provisional fixing holes 38*b* and the lever 26 is provisionally fixed at the provisional fixing position of the connector body 24, as shown in FIG. 5(*a*), the connector body 24 is inserted into the hood portion 22. Under this state, the terminals 20*a* of the female connector section 23 are not connected with those of the male connector 25.

When the connector body 24 is inserted into the hood portion 22, the provisional fixing protrusions 39 of the connector body 24 are engagingly held to the notches 28, and the projections 36 of the lever 26 are inserted into and engagingly held to the notches 28. As shown in FIG. 5(*a*), the lever 26 is rotated about the portions where the projections 36 are inserted into and engagingly held to the notches 28, by operating the operating portion 37. When the lever 26 is rotated, the connector body 24 is inserted into the inner portion of the hood portion 22 and finally completely fitted into the hood portion 22 as shown in FIG. 5(*b*). Under this state, the lever 26 is rotated from the provisional fixing position with respect to the connector body 24, and the provisional fixing protrusions 33 are disengaged from the provisional fixing holes 38*b* and engaged with the regular engaging recesses 40. The lever walls 38 of the lever 26 are interposed between the side walls 31 of the connector body 24 and the inner walls 29 of the hood portion 22. Furthermore, the lever walls 38 are rotated on the side walls 31 of the connector body 24.

Next, when the connector body 24 is to be removed from the hood portion 22 under the state where the connector body 24 is completely fitted into the hood portion 22 as shown in FIG. 5(*b*), the operating portion 37 is operated in the direction opposite to that in the above-described case, so that the lever 26 is rotated about the portions where the projections 36 are engagingly held to the notches 28. When the lever 26 is rotated, the connector body 24 is removed from the hood portion 22, thereby establishing a state where the lever is at the provisional fixing position as shown in FIG. 5(*a*) or the provisional fixing protrusions 39 are engagingly held to the notches 28. Under this state, the provisional fixing protrusions 33 are inserted into and engagingly held to the rotation holes 38*a*, and the lever 26 is located at the provisional fixing position. When the connector body 24 is then pulled out from the hood portion 22, the male connector can be removed from the female connector section 23.

In this way, in the lever fitting connector 15 of the embodiment, the lever walls 38 of the lever 26 are rotated on the side walls 31 of the connector body 24, and interposed between the side walls 31 of the connector body 24 and the inner walls 29 of the hood portion 22. Even when the lever walls 38 are provided to be outward bent, therefore, the bending of the lever walls is restricted by the inner walls 29 of the hood portion 22. Consequently, the lever walls 38 are not disengaged from the bosses 32, and the connector body 24 can be surely inserted and fitted into the hood portion 22. Furthermore, the operating force to be exerted in the inserting and fitting operation can be reduced.

Moreover, the lever fitting connector 15 of the embodiment is structured so that the plate-like lever walls 38 of the lever 26 are interposed between the side walls 31 of the connector body 24 and the inner walls 29 of the hood portion 22 and rotatable on the side walls of the connector body 24. Therefore, the portion of the lever which protrudes outside the hood portion 22 is small, and hence the connector can be miniaturized as a whole and occupy a small space.

In the embodiment, since the interior and exterior of the hood portion 22 communicate with each other through the notches 28 formed in the hood portion 22, it is possible to easily check from the outside whether the projections 36 of the lever walls 38 are inserted into and engagingly held to the notches 28 or not.

In the embodiment, the provisional fixing members are provided and the lever 26 is provisionally fixed at the provisionally fixing position with respect to the connector body 24. During an operation of inserting the connector body 24 into the hood proportion 22, therefore, the lever 26 does not rattle and hence the insertion operation is not impeded.

In the embodiment, the provisional fixing protrusions 33 are inserted into the regular engaging recesses 40 under the state where the connector body 24 is completely fitted into the hood portion 22. Therefore, the lever 26 is prevented from being accidentally rotated.

2. Second Embodiment

Next, a lever fitting connector (hereinafter, referred to as "connector") 41 of a second embodiment shown in FIGS. 6 to 9 will be described.

Figure 6:
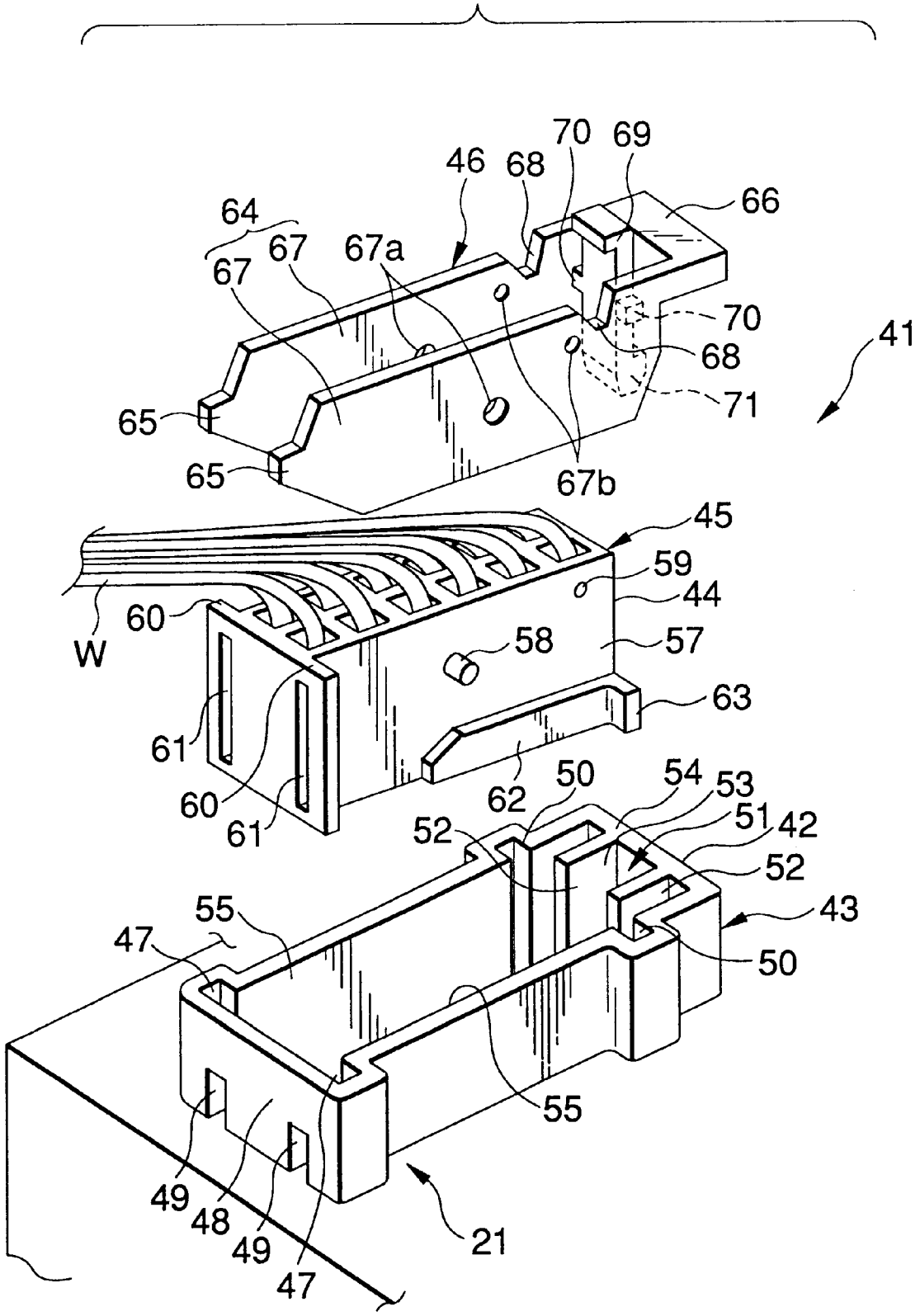
FIG. 6 is an exploded perspective view showing a second embodiment of the lever fitting connector of the present invention.

As shown in FIG. 6, in the same manner as the first embodiment, the connector 41 of the embodiment comprises: a female connector section 43 in which a hood portion 42 is formed integrally with a housing portion 21 of an upper cover 17 of an electric junction box 16; a male connector 45 having a connector body 44 which is to be inserted and fitted into the hood portion 42 of the female connector section 43; and a lever 46 which is provided on the outside of the connector body 44 of the male connector 45 and which causes the connector body 44 to be inserted and fitted into the hood portion 42 of the female connector section 43.

In the female connector section 43, terminal portions of bus bars 20 are housed in the housing portion 21, and male terminals 20*a* of the terminal portions project into the hood portion 42. One end of the hood portion 42 projects in the lateral directions so as to form rib guide grooves 47. A pair of notches 49 are formed in an outer wall 48 in which the rib guide grooves 47 are formed. Ribs 60 of the connector body 44 which will be described later are inserted into the rib guide grooves 47, and projections 65 of lever walls 67 which will be described later are inserted into and engagingly held to the notches 49, respectively.

The other end of the hood portion 42 projects in the lateral directions so as to form guide grooves 50. Guide ribs 63 which projects from the connector body 44 are to be inserted into the guide grooves 50. A lever lock portion 51 is provided at a position which is closer to the end than the guide grooves 50. In the lever lock portion 51, a pair of guide walls 52 which project toward the inside of the hood portion 42 are provided, and the space between the guide walls 52 serves as a lock piece insertion space 53.

Figure 8A:
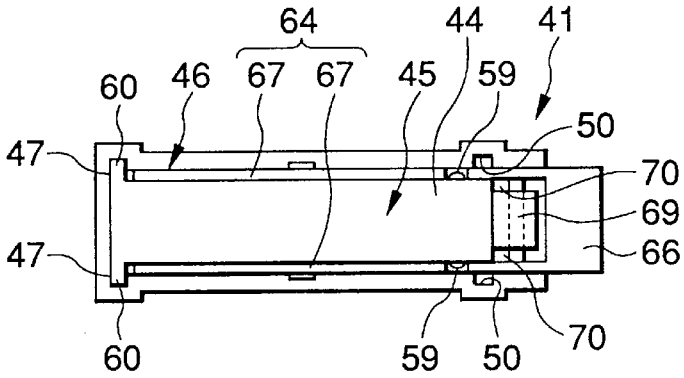
FIG. 8(*a*) is a plan view showing a state where the male connector is fitted into a female connector section in the lever fitting connector of the second embodiment.
Figure 8B:
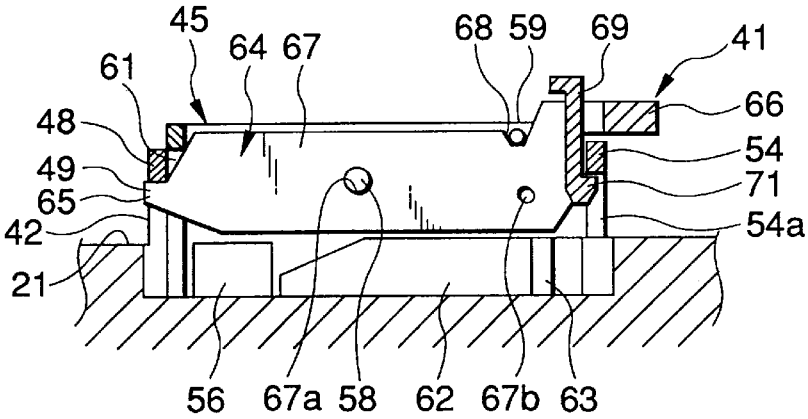
Figure 8C:
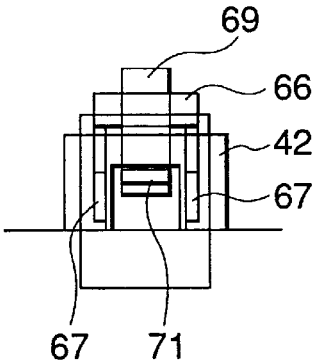

As shown in FIG. 8(*b*), a notch 54*a* is formed in an outer wall 54 from which the guide walls 52 project. A lock piece 69 of the lever 46 which is inserted into the lock piece insertion space 53 is engaged with the notch 54*a*. Moreover, thickened portions 56 for engagement of the projections are provided on inner walls 55 of the hood portion 42 and on the side of the rib guide grooves 47.

The connector body 44 of the male connector 45 is inserted and fitted into the hood portion 42 by operating the lever 46, and female terminals (not shown) housed in the connector body 44 are electrically contacted with the male terminals 20*a*.

The male connector 45 has a plurality of terminal chambers provided in the connector body 44. The female terminals are housed in the terminal chambers, respectively. The mating male terminals 20*a* are to be inserted into the terminal chambers from one side, and electric wires W which are connected at ends to the female terminals are lead out from the other side.

A cylindrical boss 58 projects from a center portion of each of side walls 57 (in FIG. 6, only one of the side walls is shown) of the connector body 44. A provisional fixing protrusion 59 which is smaller than the bosses 58 protrudes from a position which is at the upper and right side in FIG. 6 with respect to the corresponding boss 58. The bosses 58 are respectively inserted into rotation holes 67*a* formed in the lever walls 67 which will be described later. The provisional fixing protrusions 59 are inserted into and engagingly held to provisional fixing holes 67*b* formed in the lever walls 67, respectively.

Ribs 60 are provided at a side end of each of side walls 57 of the connector body 44. When the connector body 44 is inserted and fitted into the hood portion 42, the ribs 60 are inserted into the rib guide grooves 47, respectively. Slits 61 which elongate in the direction of fitting the connector body 44 into the hood portion 42 is formed in each of the ribs 60. The projections 65 of lever walls 67 which will be described later are inserted into the slits 61, respectively.

On the fitting faces of side walls 57 of the connector body 44, thickened portions 62 for preventing the connector body 44 from rattling are provided below the bosses 58, respectively. Guide ribs 63 project from the thickened portions 62. The lever 46 is disposed on the outside of the connector body 44.

The lever 46 consists of: a lever body 64 which is rotatably supported on the connector body 44 of the male connector 45; the projections 65 which are formed at one end of the lever body 64, and which, when the connector body 44 is fitted into the hood portion 42, are engagingly held to the hood portion 42; and an operating portion 66 which is provided at the other end and which causes the lever body 64 to be rotated about the portions where the projections 65 are engagingly held to the hood portion 42, thereby fitting the connector body 44 into the hood portion 42. In the lever 46 of the embodiment, as shown FIGS. 9(*a*), 9(*b*), and 9(*c*), the lever body 64 is inside the hood portion 42 under a state where the connector body 44 is fitted into the hood portion 42.

Figure 7:
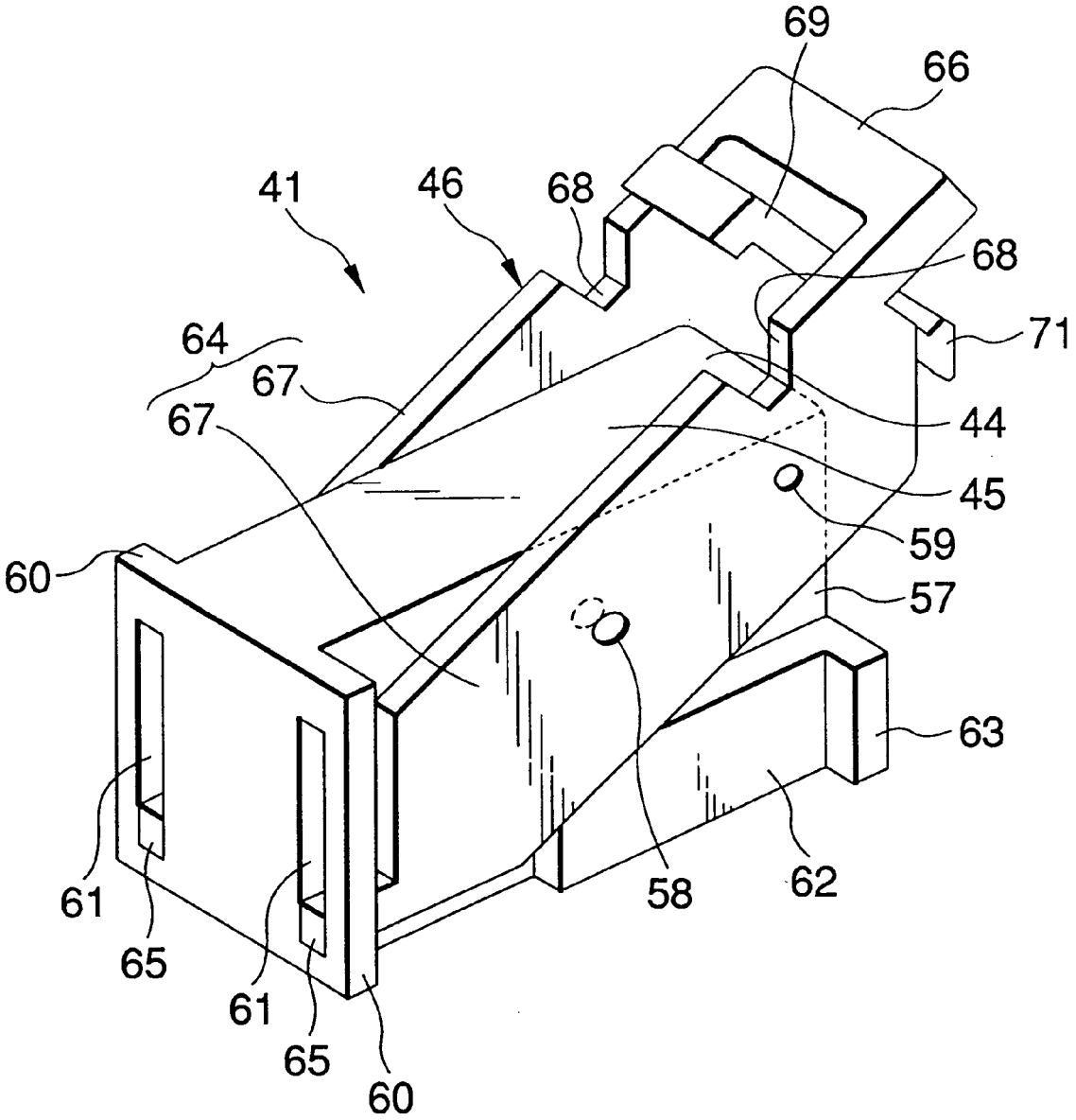
FIG. 7 is a perspective view showing a male connector of the lever fitting connector of the second embodiment, and a lever which is disposed on the outside of the male connector.

As shown in FIGS. 6 and 7, the lever body 64 consists of a pair of thin plate-like lever walls 67 which are rotatably supported on wall faces of the side walls 57 of the connector body 44, respectively. Each of the projections 65 is provided at one end of the corresponding lever wall 67. The operating portion 66 is formed by coupling the other ends of the pair of lever walls 67 with each other. The rotation holes 67*a* are formed at substantially center portions of the lever walls 67, respectively. The bosses 58 are inserted into the rotation holes 67*a*, thereby allowing the lever walls 67 to be rotated on the wall faces of the side walls 57 of the connector body 44. The provisional fixing holes 67*b* are formed in the lever walls 67, on the side of the operating portion 66. The provisional fixing protrusions 59 protruding from the side walls 57 of the connector body 44 are inserted into and engagingly held to the provisional fixing holes 67*b*, so that the lever body 64 is held at a provisional fixing position with respect to the connector body 44. The provisional fixing protrusions 59 and the provisional fixing holes 67*b* constitute the provisional fixing members. Regular engaging recesses 68 are respectively formed in the lever walls 67, on the side of the operating portion 66. Under a state where the lever 46 is provided on the outside of the connector body 44, the lever walls 67 are located above the thickened portions 62 for preventing the connector body 44 from rattling, and the projections 65 are inserted into the slits 61 formed in the ribs 60 of the connector body 44, respectively.

The lock piece 69 is provided between the lever walls 67 and on the side of the operating portion 66. The lock piece 69 is formed integrally with the side walls of the lever walls 67 through arms 70. An engaging projection 71 which is to be engaged with the notch 54*a* formed in the hood portion 42 projects from the tip end portion of the lock piece.

Under a state where the lever 46 is provided on the outside of the connector body 44 and provisionally fixed, as shown in FIG. 7, the lever walls 67 are located above the thickened portions 62 for preventing rattling, and the projections 65 abut against the upper face of the thickened portions 56 for engagement of the projections and are inserted into the slits 61. As shown in FIG. 8, the lever walls are interposed between the inner walls 55 of the hood portion 42 and the side walls 57 of the connector body 44.

Next, the procedure of fitting the male connector 45 into the female connector section 43 in the connector 41 of the second embodiment will be described.

Figure 9A:
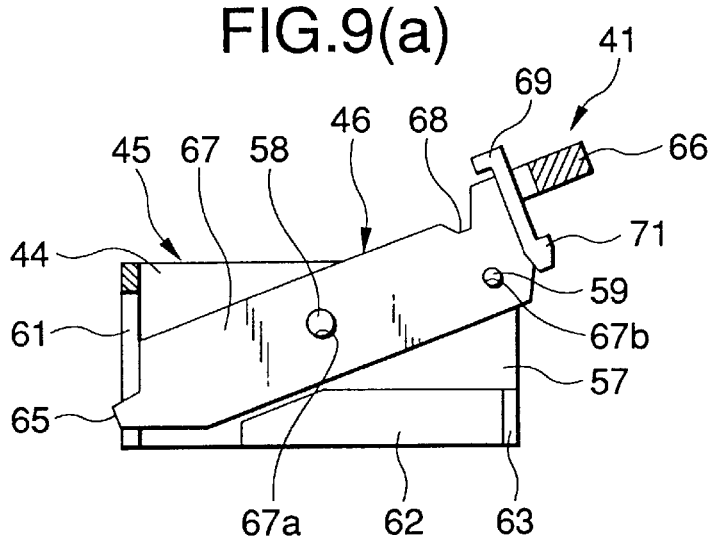
FIG. 9(*a*) is a section view showing a state where a lever is provisionally fixed to a provisional fixing position with respect to a connector body in the lever fitting connector of the second embodiment.
Figure 9B:
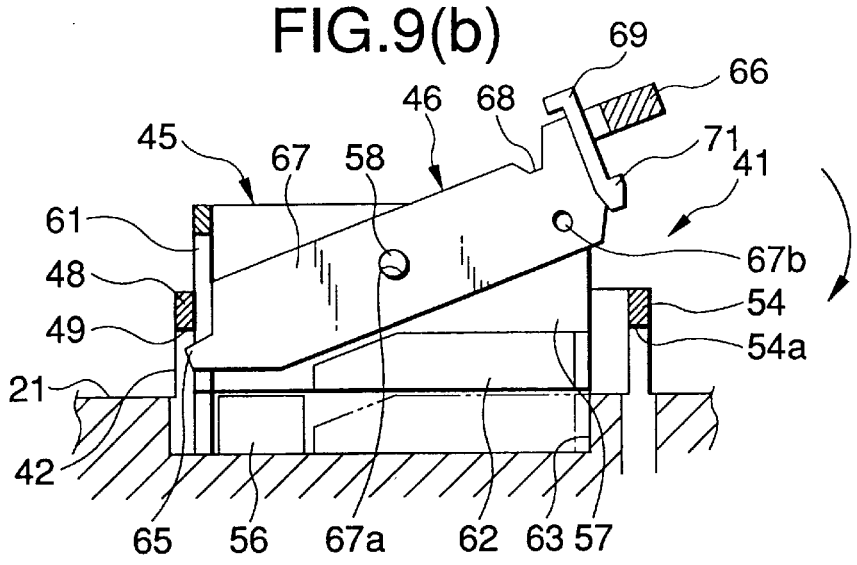
Figure 9C:
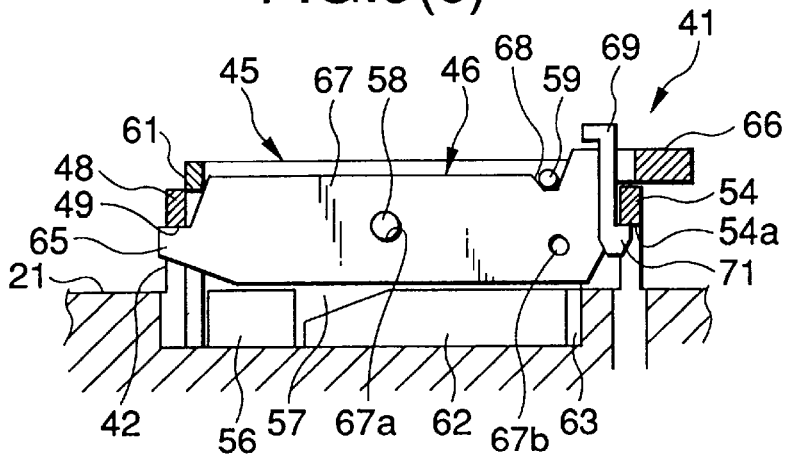
Figure 10:
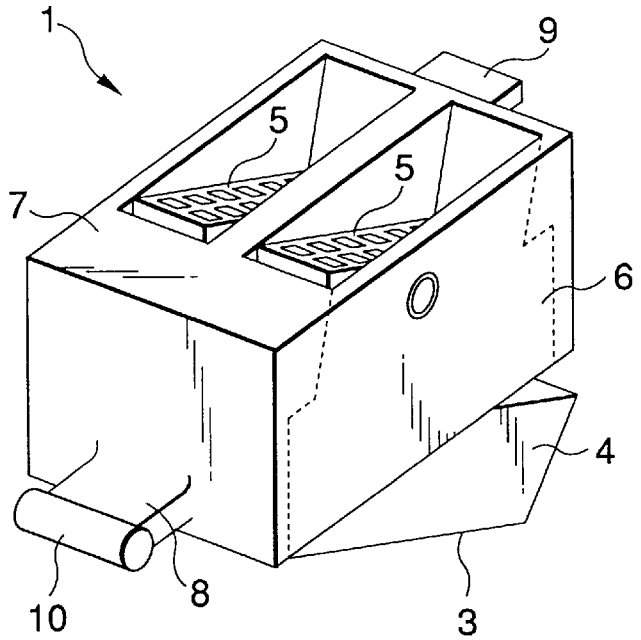
FIG.10 PRIOR ART
FIG. 10 is a perspective view showing a conventional frame-coupling type connector.
Figure 11:
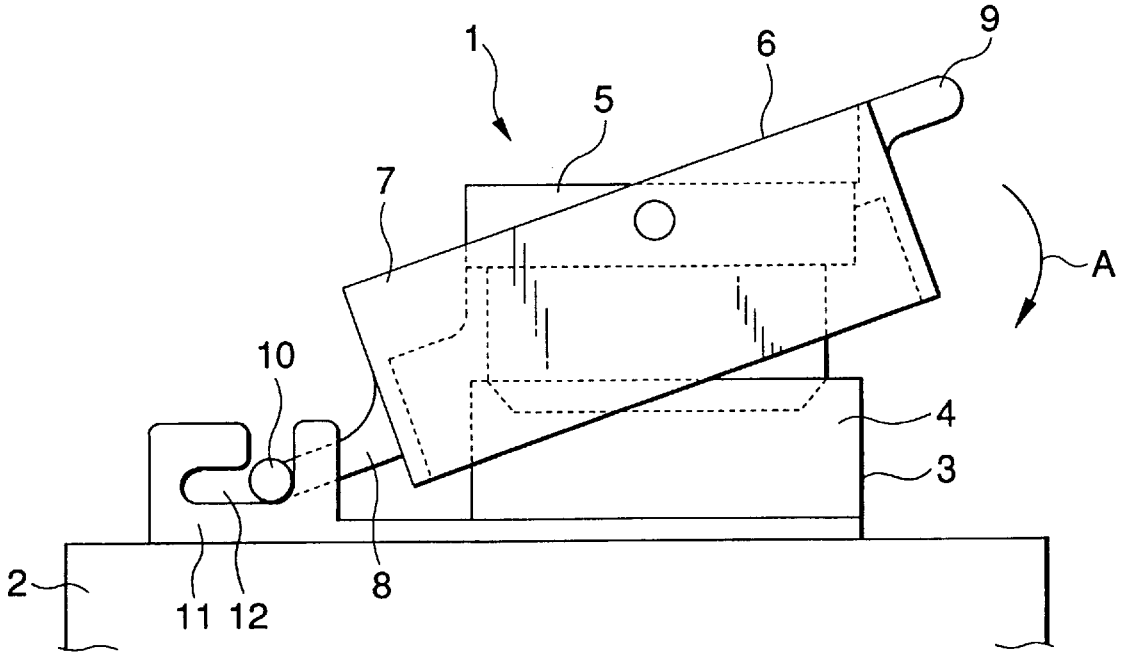
FIG.11 PRIOR ART
FIG. 11 is a side view showing a method of fitting a male connector into a female connector in the conventional frame-coupling type connector.

Under a state where the lever 46 is disposed on the outside of the connector body 44 of the male connector 45 and provisionally fixed at the provisional fixing position as shown in FIGS. 7 and 9(*a*), the connector body 44 is inserted to the provisional fixing position in the hood portion 42 as shown in FIG. 9(*b*). When the connector body 44 is inserted into the provisional fixing position in the hood portion 42, the lower end faces of the lever walls 67 abut against the thickened portions 56 so that the lever walls 67 are provisionally fixed, and the projections 65 are inserted into the notches 49.

When the operating portion 66 is operated under this state so that the lever walls 67 are slightly rotated about the bosses 58, the projections 65 in the notches 49 abut against the inner walls of the notches 49. When the lever walls 67 are further rotated, the lever walls 67 are rotated about the portions where the projections 65 abut against the notches 49. When the lever walls 67 are rotated, the connector body 44 is inserted and fitted into the inner portion of the hood portion 42. When the connector body 44 is completely inserted and fitted into the hood portion 42, the engaging projection 71 of the lock piece 69 is engagingly held to the notch 54*a*. As a result, the connector body 44 is completely fitted into the hood portion 42 and the male connector 45 is fitted into the female connector 43. Since the engaging projection 71 of the lock piece 69 is engagingly held to the notch 54*a*, the lever 46 is prevented from being unwillingly rotated.

Next, when the connector body 44 is to be removed from the hood portion 42 under the state where the connector body 44 is completely fitted into the hood portion 42 as shown in FIG. 9(*c*), the operating portion 66 is operated under a state where the lock piece 69 is bent and the engaging projection 71 is disengaged from the notch 54*a*, thereby rotating the lever walls 67 in the direction opposite to that in the above-described case. When the lever walls 67 are rotated, the connector body 44 is removed from the hood portion 42 and located at the provisional fixing position. When the connector body 44 is then upward pulled out from the hood portion 42 under this state, the connector body 44 can be removed from the hood portion 42.

In the connector 41 of the embodiment, the lever walls 67 of the lever 46 are rotated on the side walls 57 of the connector body 44, and interposed between the side walls 57 of the connector body 44 and the inner walls 55 of the hood portion 42. Even when the lever walls 67 are provided to be outward bent, therefore, the bending of the lever walls is restricted by the inner walls 55 of the hood portion 42. Consequently, the lever walls 67 are not disengaged from the bosses 58, and the connector body 44 can be surely inserted and fitted into the hood portion 42. Furthermore, the operating force to be exerted in the inserting and fitting operation can be reduced.

Moreover, the lever fitting connector 41 of the embodiment is structured so that the plate-like lever walls 67 of the lever 46 are interposed between the side walls 57 of the connector body 44 and the inner walls 55 of the hood portion 42 and rotatable on the side walls 57 of the connector body 44. Therefore, the portion of the lever which protrudes outside the hood portion 42 is small, and hence the connector can be miniaturized as a whole and occupy a small space.

In addition to the above-mentioned effects, the embodiment can attain the following effect. The projections 65 are inserted into the slits 61 on the ribs 60. Even when the lever walls 67 are bent, therefore, the projections 65 are not disengaged from the notches 49, the connector body 44 can be surely inserted and fitted into the hood portion 42 by rotating the lever 46, so that the connector body 44 can be removed out from the hood portion 42.

In the embodiment, since the thickened portions 56 for engagement of the projections are respectively provided on the inner walls 55 of the hood portion 42, the lower end faces of the lever walls 67 abut against the upper faces of the thickened portions 56 so that the lever walls 67 are provisionally fixed. Therefore, the projections 65 can be easily and surely inserted into and engagingly held to the notches 49, and caused to abut against the inner walls of the notches 49 to be engagingly held thereby, only by slightly rotating the lever walls 67.

In the embodiment, there are disposed the thickened portions 62 on the side walls 57 of the connector body 44 for preventing the connector body 44 from rattling in the hood portion 42 when the connector body 44 is fitted into the hood portion 42. As a result, no stress is applied to the portion where the terminals projecting into the hood portion 42 are connected with those in the connector body 44.

In the embodiment, the lock piece 69 is provided on the lever 46 and the engaging projection 71 of the lock piece 69 is engagingly held to the notch 54*a* formed in the outer wall 54 of the hood portion 42. Therefore, the lever 46 can be prevented from being accidentally rotated.

In the embodiment, the ribs 60 and the guide ribs 63 are provided on the connector body 44 and the rib guide grooves 47 and the guide grooves 50 are formed in the hood portion 42. Therefore, the connector body 44 can be guided in the correct fitting direction with respect to the hood portion 42 and the fitting operation can be smoothly conducted.

In the above, the embodiments in which the female connector section 23 or 43 is integrated with the electric junction box 16 have been described. Alternatively, a female connector connected with the terminals of a wire harness may be used.

3. Effects of the Invention

As has been described heretofore, according to the present invention, under the state where the connector body is fitted into the hood portion, at least the lever body is located inside the hood portion. Therefore, the lever body does not project to the outsides of the male connector and female connector section. Consequently, the connector can be miniaturized as a whole, and the space occupied by the whole of the lever fitting connector can be reduced. At least inside the hood portion, furthermore, the lever body is interposed between the walls. Even when the lever body is bent to the outside of the connector body, therefore, the lever body is blocked by the inner wall of the hood portion, so that the lever body is prevented from being disengaged from the connector body.

According to the present invention, the lever body is provisionally fixed at the provisional fixing position of the connector body. During operations of positioning the connector body to hood portion and inserting the connector body into the hood proportion, therefore, the lever does not rattle so that the inserting operation is not impeded.

According to the present invention, the provisional fixing protrusion of the connector body is inserted into and engagingly held to the provisional fixing hole of the lever body and the lever body is held at the provisional fixing position of the connector body. During the operation of inserting the connector body into the hood portion, therefore, the lever does not impede the inserting operation.

According to the present invention, when the connector is positioned on the hood portion, the connector body is inserted into the hood portion, and the lever is rotated, the engaging projection provided at the one end of the lever body is engagingly held to the notch of the hood portion. When the lever is further rotated, the lever body is rotated about the portion where the engaging projection is engagingly held to the notch, and the connector body is easily inserted and fitted into the hood portion. Since the interior and exterior of the hood portion communicate with each other through the notch to which the engaging projection is engagingly held, moreover, it is possible to easily check whether the engaging projection is surely engagingly held to the notch or not.

According to the present invention, the lever walls are provided on the side walls of the connector body, respectively. When the connector body is to be inserted into the hood portion, therefore, an unbalanced force is not applied to the connector body and the connector body can be inserted and fitted into the hood portion while the connector body is moved toward the hood portion along the correct direction of fitting into the hood portion.

According to the present invention, since the lever walls are interposed between the side walls of the connector body and the inner walls of the hood portion, respectively, the bending of the lever walls is restricted by the inner walls of the hood portion, so that the lever walls are prevented from being disengaged from the bosses of the connector body. The connector body can be surely fitted into and removed from the hood portion, by rotating the lever.

According to the present invention, when the lever walls are rotated about the portions where the engaging projections are engagingly held to the hood portion, the engaging projections are guided and supported by the grooves provided in the connector body. Even when the lever walls are bent, therefore, the lever walls are prevented from being disengaged from the portions where the projections are engagingly held to the hood portion.

According to the present invention, when the connector body is inserted into the hood portion after the connector body is positioned on the hood portion, the end faces of the lever walls on the side of the projection abut against the thickened portions, thereby provisionally fixing the engaging projections to the notches. When the lever body is slightly rotated, therefore, the engaging projections can easily abut against the notches to be engagingly held thereto.

According to the present invention, since the thickened portions for preventing rattling are provided on the side of fitting faces of the connector body and the lower portions of the lever walls, it is possible to eliminate gaps which may be formed by respectively interposing the lever walls between the connector body and the inner walls of the hood portion, and which correspond to the thickness of the lever walls. As a result, the rattling of the connector body in the hood portion is suppressed, and a force which is applied to contact portions of the terminals is reduced.

What is claimed is:

1. A lever fitting connector comprising:

a female connector having a hood-like outer peripheral wall;

a male connector fitted into the female connector;

a lever body supported rotatably on an outer face of a side wall of the male connector;

an engaging projection, provided at one end of the lever body, for engaging with the outer peripheral wall of the female connector; and an operating portion, provided at the other end of the lever body, for fitting the male connector with the female connector by rotating the lever body about a portion where the engaging projection is engaged with the outer peripheral wall of the female connector, wherein the lever body is located inside of the outer peripheral wall of the female connector when the male connector is completely fitted into the female connector so that only the operating portion protrudes from the female connector.

2. The lever fitting connector as set forth in claim 1 further comprising:

a provisional fixing member for provisionally fixing the lever body at a predetermined position before the male connector is fitted into the female connector.

3. The lever fitting connector as set forth in claim 2, wherein the provisional fixing member includes a provisional fixing protrusion which is protruded from the outer face of the side wall of the male connector, and a provisional fixing hole which is formed in the lever body, the provisional fixing protrusion being to be inserted into and engagingly held to the provisional fixing hole.

4. The lever fitting connector as set forth in claim 2, wherein the provisional fixation by the provisional fixing member is released when the engaging projection is engaged with the outer peripheral wall of the female connector.

5. The lever fitting connector as set forth in claim 1, wherein a notch is formed in the female connector so as to communicate an interior and an exterior of outer peripheral wall of the female connector communicating with each other, the engaging projection is inserted into and engagingly held to the notch.

6. The lever fitting connector as set forth in claim 1, wherein the lever body includes a pair of lever walls which are rotatably supported on outer faces of side walls of the male connector, respectively, the engaging projection is provided at one end of each of the lever walls, and the operating portion is formed so as to couple the other ends of the pair of lever walls with each other.

7. The lever fitting connector as set forth in claim 6, wherein the pair of lever walls are rotatably supported on supporting projections which respectively project from the outer faces of the side walls of the male connector, and wherein, the lever walls are located inside of the outer peripheral wall of the female connector when the male connector is completely fitted into the female connector.

8. The lever fitting connector as set forth in claim 6, wherein slits are provided in the male connector, the slits guiding and supporting the engaging projections when the lever walls are rotated about portions where the engaging projections are engagingly held to the female connector.

9. The lever fitting connector as set forth in claim 6, wherein thickened portions provided respectively on inner faces of the outer peripheral wall of the female connector, the thickened portions abut against and support the lower portion of the one end of the lever body in which the engaging projections are provided.

10. The lever fitting connector as set forth in claim 6, wherein thickened portions provided respectively on the side walls of the male connector for restricting movement thereof when the male connector is completely fitted into inside of the outer peripheral wall of the female connector.

11. The lever fitting connector as set forth in claim 10, wherein the thickened portions in the male connector further includes position restriction projections which are respectively protruded therefrom, the outer peripheral wall of the female connector further includes position restriction grooves provided on the inner faces thereof, and the position restriction projections is respectively engaged with the position restriction grooves when the male connector is completely fitted into the female connector.

* * * * *